US006039927A

United States Patent [19]

Greco

[11] Patent Number: 6,039,927

[45] Date of Patent: Mar. 21, 2000

[54] VALVE SYSTEM FOR REGENERATIVE THERMAL OXIDIZERS

[76] Inventor: Richard Greco, 89 Onyx Pl., Matawan, N.J. 07747

[21] Appl. No.: 08/964,440

[22] Filed: Nov. 4, 1997

[51] Int. Cl.[7] ..... F01N 3/10; F16K 11/00

[52] U.S. Cl. ..... 422/175; 422/173; 422/176; 432/181; 432/182; 110/211; 110/235; 110/236; 137/309; 251/251

[58] Field of Search ..... 422/171, 176, 422/173, 175; 431/5, 7, 170; 165/4, 7; 110/236, 235, 211, 246; 432/180–182; 137/309, 311, 870; 251/129.11, 251

[56] References Cited

U.S. PATENT DOCUMENTS 5,129,332 7/1992 Greco ..... 422/175

5,375,622 12/1994 Houston ..... 137/240

*Primary Examiner*—Hien Tran

*Attorney, Agent, or Firm*—Dykema Gossett PLLC

[57] ABSTRACT

A two chamber regenerative thermal oxidizer has a pair of poppet valves actuated by an eccentric mechanical drive assembly having a single drive shaft. Gas flow through the RTO is reversed by the simultaneous opening and closing of the poppet valves. Deceleration of the valve discs is controlled using a variable speed motor to reduce valve damage. In another configuration, the mechanical eccentric drive controls two sets of butterfly valves in an RTO.

19 Claims, 5 Drawing Sheets

VALVE SYSTEM FOR REGENERATIVE THERMAL OXIDIZERS

TECHNICAL FIELD OF THE INVENTION

The present invention relates generally to regenerative thermal oxidizers. More specifically, the present invention relates to valve systems for two chamber regenerative thermal oxidizers.

BACKGROUND OF THE INVENTION

Thermal regenerative oxidizers (RTOs) are used in a number of industries to reduce the quantity of contaminants in process effluent gases. RTOs are unique in their ability to conserve fuel through the use of heat exchangers. In an RTO, the process effluent gases are oxidized in a combustion chamber. As the high-temperature combustion gases move to an exhaust stack, they flow through a heat exchanger, typically a chamber filled with ceramic saddles or the like. In the heat exchanger, up to 95% of the heat is transferred from the gases to the ceramic saddles. The flow of gases is then reversed such that the inlet process gases move through the heat exchanger toward the combustion chamber. Heat is transferred from the hot ceramic media to the process gases and consequently less energy is required to oxidize the process gases in the combustion chamber.

Several configurations of RTOs have been developed based on this heat recovery principle. In an RTO having three or more chambers, one heat exchanger sequentially serves as a standby chamber such that the continuous flow of process gas is not interrupted during flow reversal. In a two chamber RTO, however, neither of the heat exchangers can function as a standby chamber and thus the problem of handling a continuous process gas stream is more difficult. In a two chamber RTO both heat exchangers are separately attached to a shared combustion chamber. A flow path is thereby established that extends from the inlet of one heat exchanger, through the heat exchange medium, into the combustion chamber and then out via the second heat exchange chamber. In order for the incoming process gas to capture heat from the heat exchangers, gas flow through the RTO must be periodically reversed. And, as will be appreciated by those skilled in the art, flow reversal must occur in a manner which minimizes discharge of unoxidized process gas to the atmosphere.

The prior art has used electronic and hydraulic controls to actuate valves in RTOs. It is difficult, however, to properly time the opening and closing of the valves associated with the heat exchange chambers and still maintain steady inlet pressures.

Further, hydraulically opened and closed valves tend to significantly restrict the flow of gas through the valves when they first begin to close, but then slowly taper to zero. Accordingly, the valves are restricted in a manner which results in low flow percentages for a relatively long portion of the cycle.

Various types of cams and other mechanical actuation systems have also been used to open and close inlet and outlet butterfly/wafer valves in three chamber RTOs. These have included mechanically operated means which have utilized eccentrically mounted secondary shafts driven by a main shaft.

In the case of two chamber RTOs the most frequently used valve system employs poppet valves actuated by hydraulic or air linear actuators connected to the valve shaft. Poppet valves go from zero flow to full flow quickly and the opening and closing of the poppets minimizes the tendency of foreign particles carried by the gases to be trapped in the valve. Gas moving through the valve is directed by the position of a disc or "poppet" which is fixed on a stem. The disc is moved linearly so that it seats on one of two opposed valve seats.

In two chamber RTOs, two poppet valves are employed, each having its own hydraulic or air linear actuator. It will be appreciated that for efficient operation, both poppet valves must be timed so that they open and close as fast as possible, forming substantially air-tight seals. While hydraulic or air linear actuated poppet valves have some advantages (i.e., the overall simplicity of poppet valves), for large RTOs such systems are not always reliable. For example, in a large RTO a poppet disc may weigh in excess of 300 pounds and may cycle 200,000 times per year. With discs of this size, poppet valves actuated hydraulically or by air linear means are inadequate to provide control and sealing force to the degree required for reliable operation. Moreover, due to the force with which the valves are closed, they may cause premature wear of valve seats, i.e. due to the "slamming" of the disc against the valve seat. Moreover, the lack of constant air pressure in RTOs, the temperature variability of many hydraulic fluids, as speed varies season to season due to ambient variances and occasional frozen air lines, and a number of other factors make these conventional systems less than optimum.

Therefore it would be desirable to provide a two chamber RTO valve system which addresses the problems inherent in the prior art. The present invention meets these objectives.

SUMMARY OF THE INVENTION

In one aspect the present invention provides a two chamber regenerative thermal oxidizer having an improved valve system. The valve system combines two poppet type valves in a side-by-side relationship with the poppet stems extending parallel to one another to a mechanical drive system. The mechanical drive employs a variable speed motor and a gear reducer for rotating a drive shaft. A disc or ring is mounted at each end of the drive shaft with each disc having a pin at its edge (eccentrically position on the disc). The pins of the discs are placed out of phase 180 degrees with each other. Linkage is provided which connects the pin of each disc to one of the poppet stems. As the drive shaft rotates 180 degrees the respective poppet discs move between their opposed valve seats to change the direction of flow through the valve system. By virtue of the relative placement of the pins, as one poppet disc "opens" the other disc "closes." This valve system provides a reliable method for reversing the flow of gases through the RTO.

In another aspect, a variable speed motor is provided which allows the drive shaft acceleration and deceleration to be adjusted. This is achieved through a variable speed regulator in association with the drive motor. Rates are selected which optimize the rapid opening of the valves, but which reduce the impact force of the poppet discs on the valve seats. In one aspect, proximity switches are provided in association with the drive shaft which trigger deceleration based on the rotational position of the shaft.

Thus, in one aspect the present invention provides a regenerative thermal oxidizer having a first heat exchanger defining a first flow path; a first inlet/outlet in association with the first heat exchanger, the first inlet/outlet providing flow access to the first flow path; a second heat exchanger defining a second flow path; a second inlet/outlet in association with the second heat exchanger, the second inlet/ outlet providing flow access to the second flow path; a valve assembly having at least two poppet discs, the valve assembly defining multiple flow passages; the valve assembly being in flow communication with the first and second inlet/outlets; each of the poppet discs being mounted on a rod; an eccentric mechanical drive, the eccentric mechanical drive having a drive shaft and linkage attached to the drive shaft; the rods being attached to the eccentric mechanical drive via the linkage.

In still another aspect, the eccentric drive valve system of the present invention actuates two pairs of butterfly valves which open and close the RTO chambers. Each disc of a pair of opposed drive discs has an associated pair of articulated linkages which operate the valves.

These and other aspects, features and advantages of the invention will be more fully explained in the following detailed description of the preferred embodiments with reference to the drawings.

DETAILED DESCRIPTION OF THE PREFERRED EMBODIMENTS OF THE INVENTION

Figure 1:
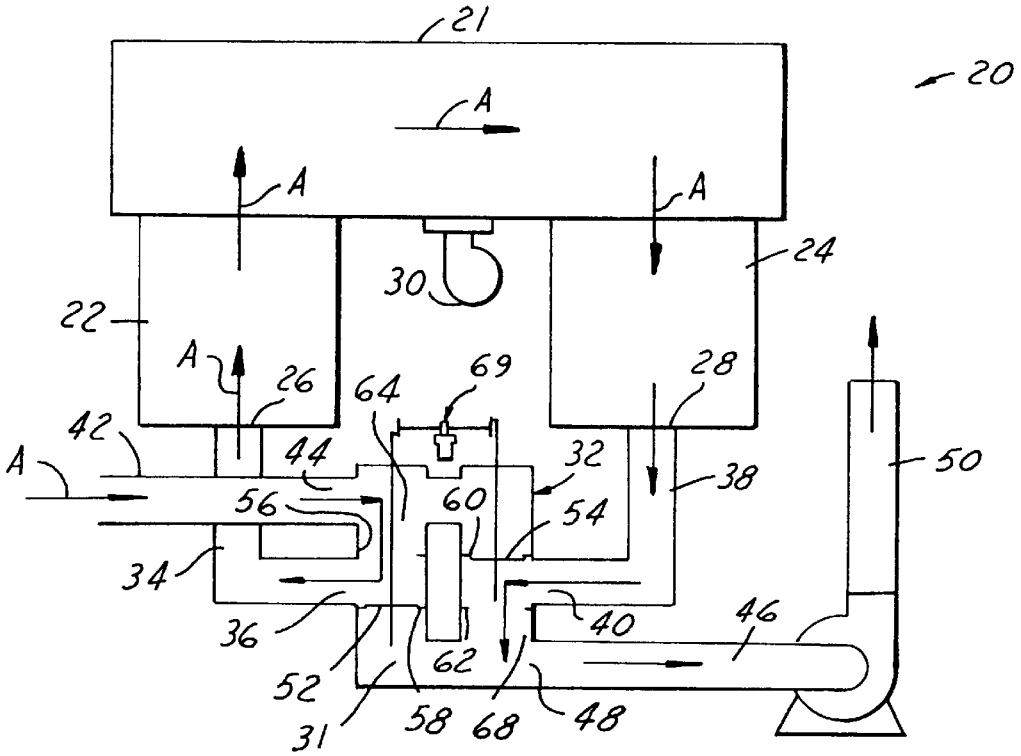
FIG. 1 diagrammatically illustrates the components and operation of the present invention in one mode of operation.

Referring now to FIG. 1 of the drawings, regenerative thermal oxidizer or incinerator 20 is shown diagrammatically having common combustion chamber 21 in flow communication with first and second heat exchangers 22, 24. As will be appreciated by those skilled in the art of regenerative incinerators, heat exchangers 22 and 24 define chambers which house a heat exchange element such as ceramic saddles or porous ceramic monoliths. Heat exchanger 22 has inlet/outlet 26 through which gas enters and exits the chamber. Similarly, heat exchanger 24 has inlet/outlet 28 which provides flow access. The opposite ends of heat exchangers 22 and 24 are attached to combustion chamber 21 in the standard fashion; that is, a flow passage is created by which process gases can flow into one of the heat exchangers, into the combustion chamber (which is equipped with a burner 30) and then out through the opposite heat exchanger. As described in the background section of this application, as the hot combustion gases flow through the exit heat exchanger heat is transferred to the ceramic heat exchange media. The path of gases through heat exchangers 22 and 24 and combustion chamber 21 are shown by the arrows marked "A" in FIG. 1 in one mode of operation.

Still referring to FIG. 1 of the drawings, the duct and valve assembly of the invention will now be described. There are essentially four ducts or passages for gas from the heat exchangers to the valve body 31 of valve assembly 32. The first is transfer duct 34 which is in flow communication with heat exchanger 22. Transfer duct 34 extends between heat exchanger 22 and valve port 36. Second transfer duct 38 extends from heat exchanger 24 to port 40 of valve body 31. Inlet or process gas duct 42 extends from the source of process gas (not shown) to port 44 of valve body 31. Finally, outlet or exhaust gas duct 46 extends from port 48 of valve body 31 to exhaust stack 50.

Valve body 31 defines several flow passages through which gases flow as directed by the opening and closing of valve discs or poppets 52 and 54 relative to valve seats 56, 58, 60 and 62. More specifically, and referring to FIG. 1 of the drawings, forward inlet passage 64 is defined by valve body 31 when disc 52 is seated on valve seat 58 and disc 54 covers seat 60. In this mode of operation, process gases move in the direction of arrows "A", i.e. from the process stream into and through heat exchanger 22, into combustion chamber 21, through heat exchanger 24, back through valve body 31 via forward outlet passage 68 and then through duct 46 to exhaust stack 50. For ease of explanation this will be referred to as the forward mode or operation of RTO 20.

Figure 2:
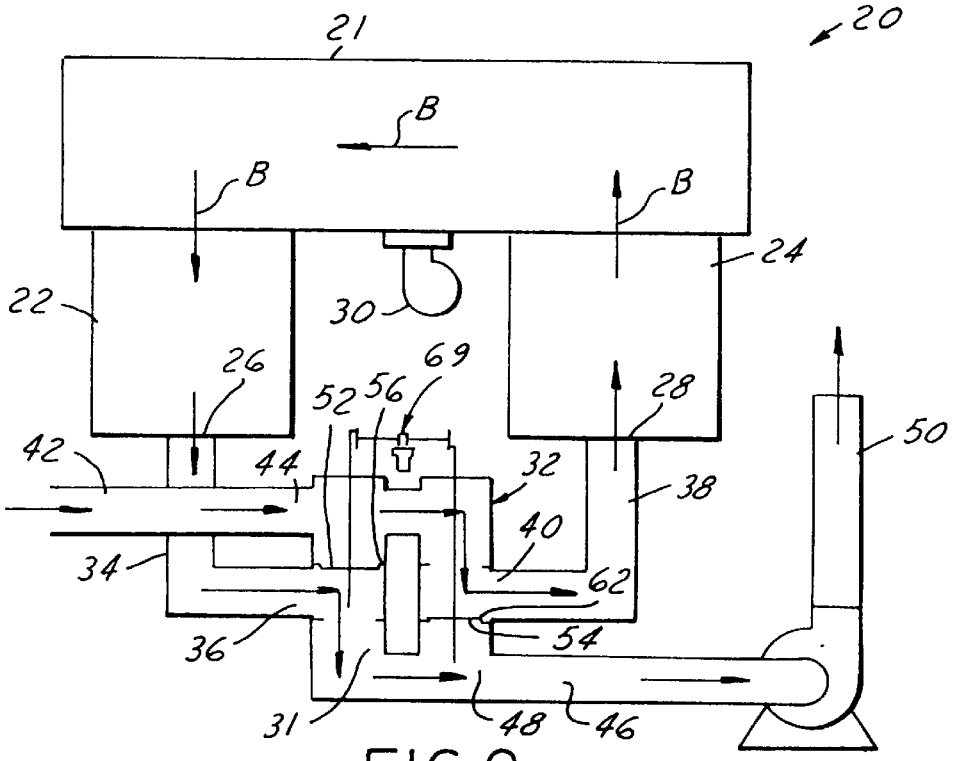
FIG. 2 diagrammatically illustrates the components and operation of the present invention in another mode of operation.
Figure 3:
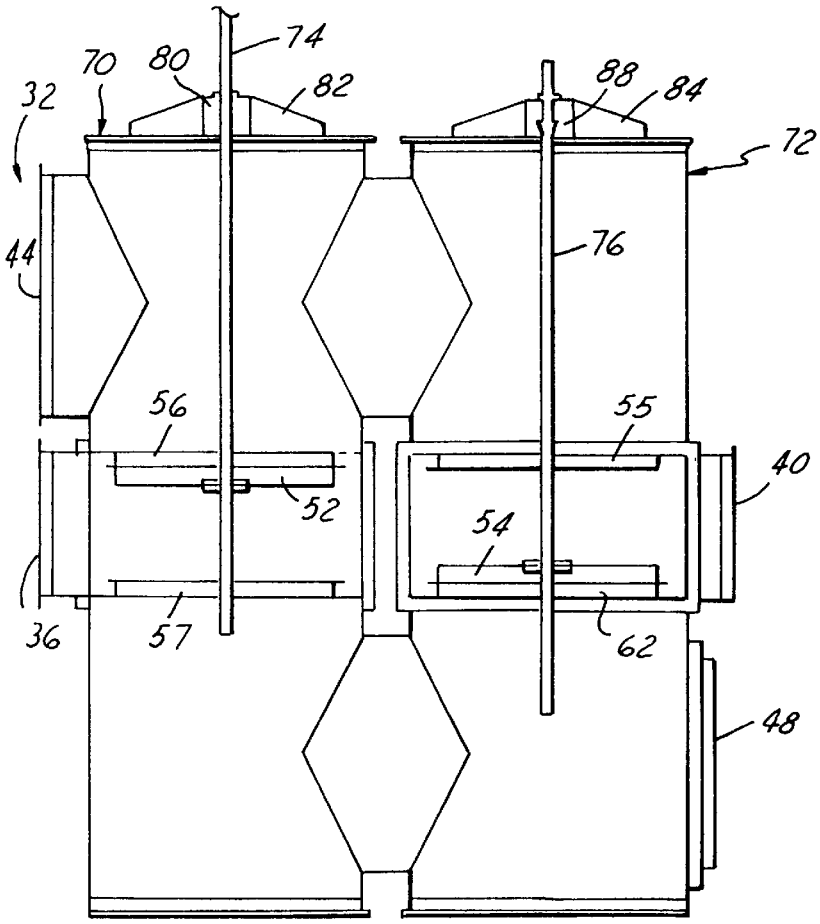
FIG. 3 is a diagrammatic elevational view of the valve of the present invention.

In a most preferred embodiment, and referring now to FIG. 3 of the drawings, valve body 31 has the configuration of two multiport poppet valves 70, 72 in side-by-side arrangement. Stems or rods 74 and 76 are attached to discs 52 and 54, respectively. Retainers 82 and 84 and there associated packings 86 and 88 maintain rods 74 and 76 in position and provide a gas-tight bearing surface for the rods. Discs 52 and 54 will typically be formed of metal and are locked on to rods 74 and 76. That is, one disc is mounted on each rod. The two positions of each disc are shown for each poppet in FIG. 3 on valve seats 56 and 62. The opposing valve seats 55, 57 are also shown. Ports 44, 36, 40 and 48 corresponding to the structures shown diagrammatically in FIGS. 1 and 2 are also shown. It will be understood that discs 52, 54 move linearly as their respective rods 74, 76 move by virtue of the action of valve drive assembly 69. Also the flow of gases through valve body is as shown and described in connection with FIG. 1 and 2 of the drawings.

Figure 4:
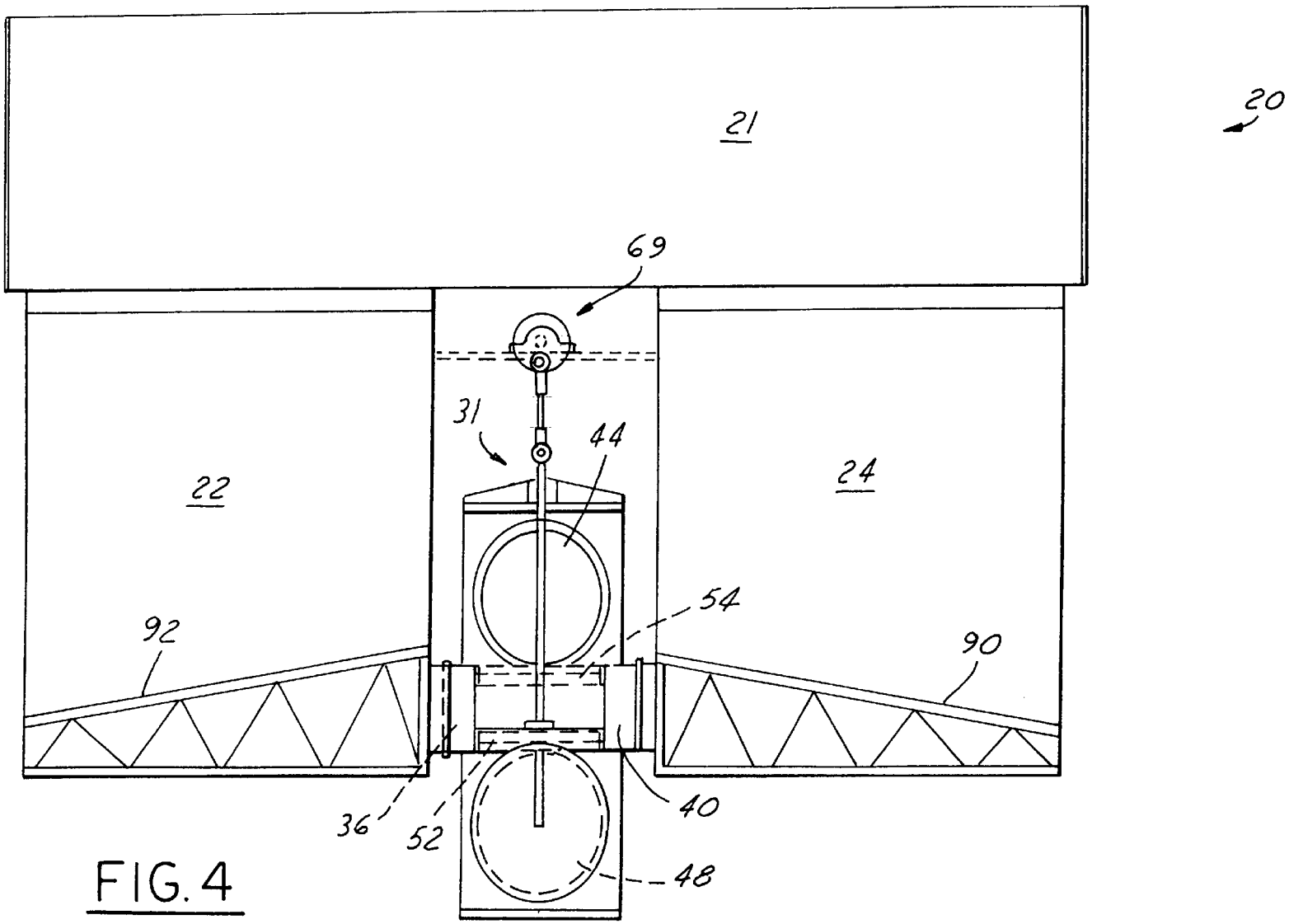
FIG. 4 is a diagrammatic side elevational view of the RTO of the present invention in one configuration.

Referring now to FIG. 4 of the drawings, RTO 20 is shown having combustion chamber 21 in communication with heat exchange chambers 22 and 24. Supports 90 and 92 serve to support the heat exchange media (not shown) in the heat exchange chambers. Valve assembly 31 is shown having ports 36 and 40 leading to heat exchangers 22 and 24 respectively. Poppet valve disc 52 is shown in the "down" position and poppet valve disc 54 is shown in the "up" position for flow in accordance with the forward mode of operation shown in FIG. 1 of the drawings. In FIG. 4, the position of ports 36 and 40 are shown in an alternate embodiment perpendicular to ports 44 and 48. Port 48 and 36 and poppet disc 54 are shown in phantom to better illustrate their relative positions in terms of depth in FIG. 4.

Figure 5:
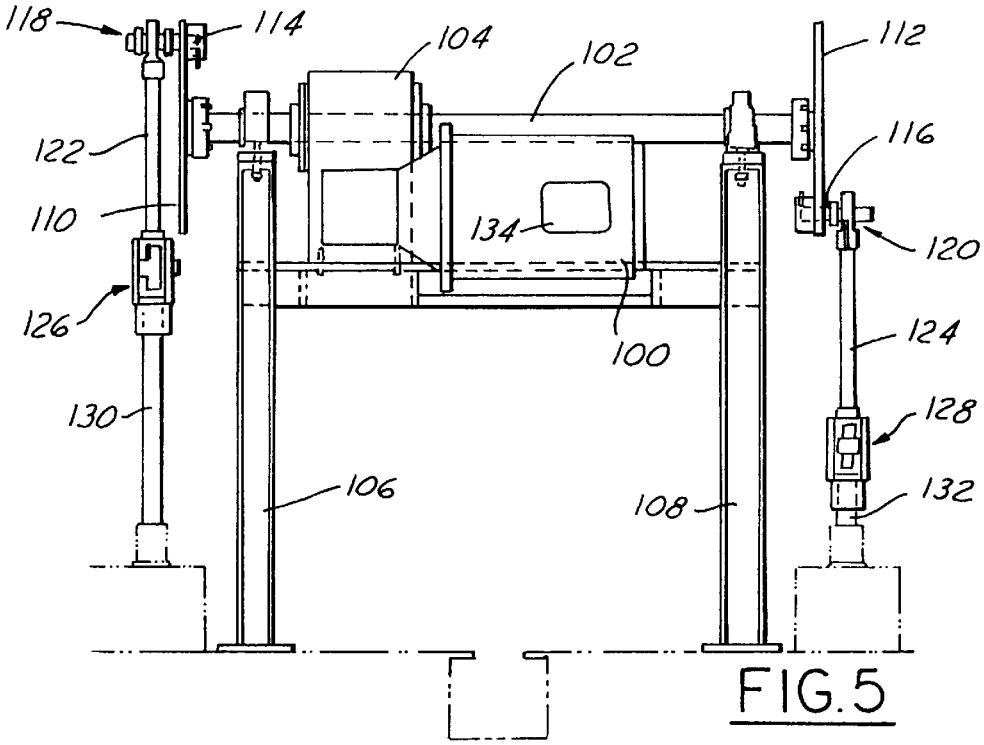
FIG. 5 is a front view of the valve actuation system of the present invention.

Referring now to FIG. 5 of the drawings, valve drive assembly 69 is shown in more detail. Valve drive assembly has motor 100 which provides power to shaft 102 via gear reducer 104. Gear reducer 104 not only steps down the motor speed but also prevents shaft 102 from coasting beyond BDC (bottom dead center) or TDC (top dead center) or from reversing. Shaft 102 is journaled on supports or posts 106 and 108. At each end of shaft 102 is a center hub disc 110 and 112. Hub discs 1 10 and 112 each have an eccentrically mounted offset pin 114 and 116. An overdrive bearing spring assembly 118 and 120 is connected to each offset pin 114, 116 respectively. Adjustable length connecting rods 122 and 124 attach spring assemblies 118, 120 to yoke and swivel bearing assemblies 126 and 128 which are in turn attached to valve actuation rods 130 and 132. Offset pin 114 is position at 180 degrees relative to offset pin 116 in the preferred embodiment. Variable speed drive controller 134 regulates the speed of motor 100 in a manner described more fully hereinafter.

Figure 6:
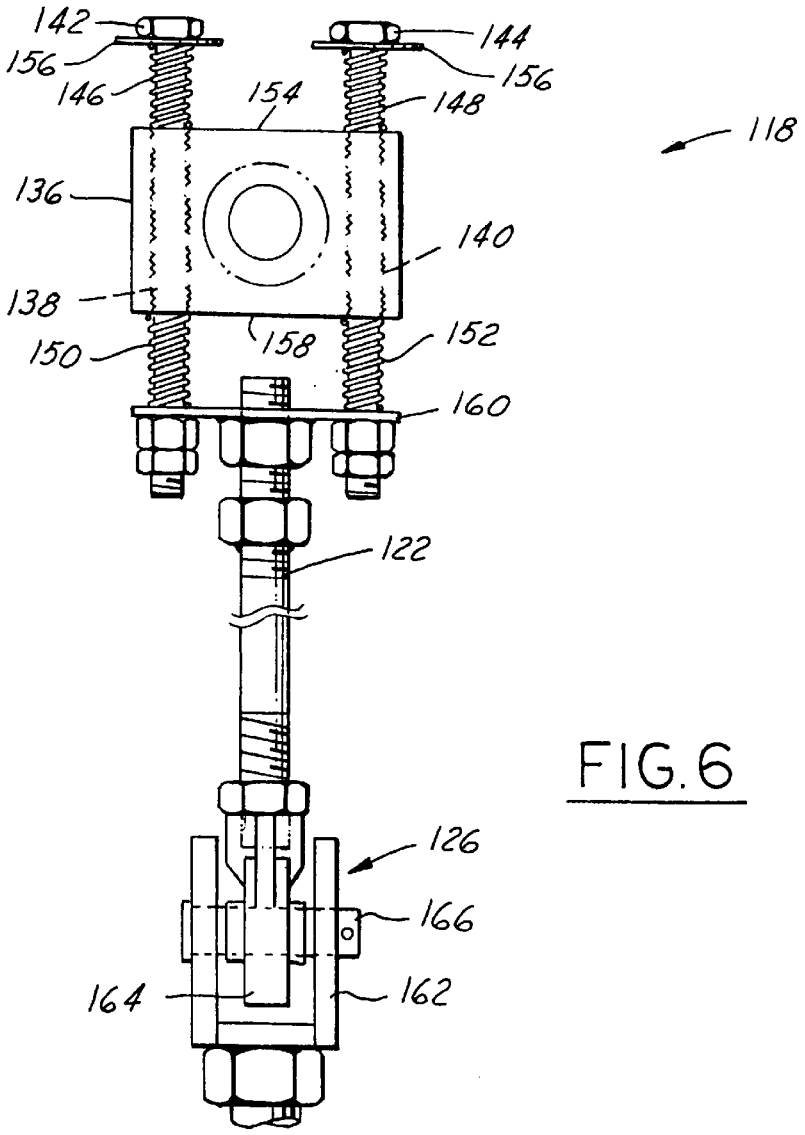
FIG. 6 is a front view of the spring assembly and yoke and swivel assembly, with the spring block turned 90 degrees for ease of illustration.

Referring now to FIG. 6 of the drawings, spring assembly 118 is shown in more detail having spring block 136 which has been rotated 90 degrees with respect to yoke and swivel bearing assembly 126 for ease of explanation and illustration. It is to be understood that spring assemblies 118 and 120 are of the same design. Spring block 136 has two throughbores 138 and 140 shown in phantom and through which bolts 142 and 144 extend. Four compression springs 146, 148, 150 and 152 are provided. Springs 146 and 148 extend between block face 154 and washers 156. Springs 150 and 152 extend between block face 158 and plate 160. Thus, it will be appreciated that block 136 is spring biased along bolts 142 and 144. Plate 160 is attached to adjustable length connecting rod 122. Yoke and swivel bearing assembly 126 has yoke 162 and collar 164 which is freely rotatable around pin 166. Valve actuator rod 130 is shown attached to yoke 162.

Referring again to FIG. 5 of the drawings, variable speed drive controller 134 regulates the speed of motor 100 such that a gear reducer 104 that provides an approximate target speed can be utilized. In addition, variable speed drive controller 134 allows control of acceleration and deceleration. More specifically, and with regard to the operation of incinerator 20 generally, an electric timing command from controller 134 starts motor 100 which, via gear reducer 104, initiates rotation of shaft 102. Rotation accelerates to a predetermined rps. Due to the relative positions of pins 114 and 116, the rotation cycle will be 180 degrees. For example, if a rotation speed setting of 1 revolution per second is used with pins 114 and 116 offset 6 inches from the centers of discs 110 and 112 where the spacings between seats 56 and 57 (FIG. 3) is 11.75 inches, then disc 52 will move close to one of the valve seats in less than ½ second. The remaining 0.25 inches of movement of disc shaft 74 as pin 114 moves to bottom dead center or top dead center will be taken up by sealing deflection of poppet disc 52 on the valve seat and through movement of block 136 on springs 146–152.

Most preferably, the acceleration of drive shaft 102 and, more importantly, deceleration is controlled using controller 134 to prevent poppet discs 52 and 54 from contacting their respective valve seats with excessive force (causing premature wear). In one preferred embodiment, proximity switches on the gear reducer housing and shaft 102 can be provided such that upon predetermined rotation of shaft 102 the switches are triggered to start deceleration. For example, if the proximity switch is set to set to trigger at 90 degrees rotation, with the variable speed drive controller set at one rps and the acceleration rate set at 0.2 seconds with the deceleration rate set at 0.3 seconds then shaft 102 will ramp up to one rps in 0.2 seconds, trigger at 90 degrees and decelerate for 0.3 seconds. This produces a bell curve time speed relationship whose total 180 degree of travel is ½ second and whose velocity at the beginning and end of travel is zero.

Figure 8:
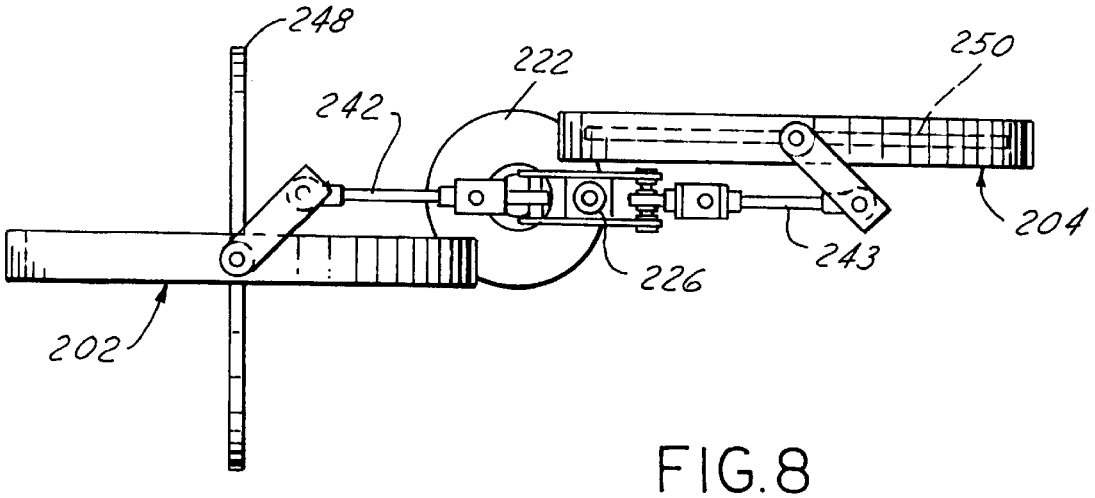
FIG. 8 is a side view of the assembly shown in FIG. 7.
Figure 7:
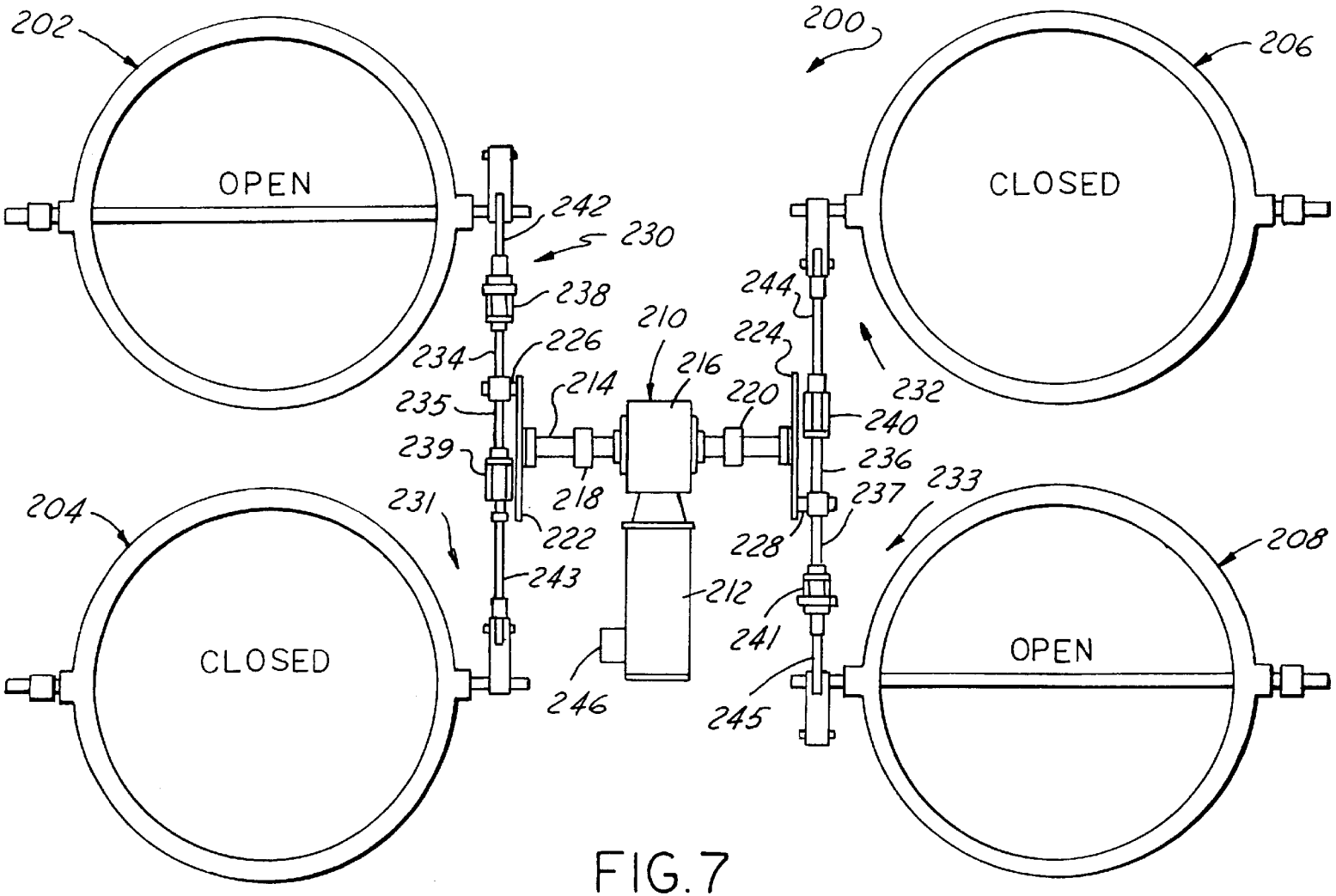
FIG. 7 is a diagrammatic illustration of the present invention in another embodiment in which butterfly valves are opened and closed by the eccentric dual valve linkage.

In another embodiment of the present invention, and referring now to FIG. 7 of the drawings, valve assembly 200 is shown having butterfly or wafer valves 202, 204, 206 and 208, the valve elements of which are opened and closed by valve drive assembly 210. As in the previous embodiment, valve drive assembly 200 has motor 212 which provides power to shaft 214 via gear reducer 216. Again, gear reducer 216 not only steps down the motor speed but also prevents shaft 214 from coasting beyond BDC or TDC or from reversing. Shaft 214 is journaled on supports or posts 218 and 220. At each end of shaft 214 is a center hub disc 222 and 224. Hub discs 222 and 224 each have an eccentrically mounted offset pin 226 and 228 as described in the previous embodiment. Overdrive bearing spring assemblies 230, 231 and 232, 233 are connected, respectively, in dual fashion to each offset pin 226, 228. Adjustable length connecting rods 234, 235 and 236, 237 attach spring assemblies 230, 231 and 232, 233 to yoke and swivel bearing assemblies 238, 239 and 240, 241 which are in turn attached, respectively, to valve actuation rods 242, 243 and 244, 245. Offset pin 226 is positioned at 180 degrees relative to offset pin 228. Variable speed drive controller 246 again regulates the speed of motor 212. In FIG. 8, the operation of valve assembly 200 is shown with valves 202 and 204 having a vertical offset from one another. Valve member 248 is shown "open" and valve member 250 (in phantom) is shown "closed." It will be understood that with valve assembly 200 the duct work shown in connection with the previous embodiments will be modified somewhat, and referring now again to FIGS. 1 and 2 of the drawings, such that valve 202 opens and closes the port at 44; valve 204 opens and closes the port at 36; valve 206 open and closes the port at 40; and valve 208 open and closes the port at 48. The other features of the previous embodiments, such as controlled deceleration and the use of proximity switches may be desirable for use in this embodiment in some applications.

What is claimed is:

1. A regenerative thermal oxidizer, comprising:

a first heat exchanger defining a first flow path;

a first inlet/outlet in association with said first heat exchanger, said first inlet/outlet providing flow access to said first flow path;

a second heat exchanger defining a second flow path;

a second inlet/outlet in association with said second heat exchanger, said second inlet/outlet providing flow access to said second flow path;

a valve assembly having at least two poppet discs, said valve assembly defining multiple flow passages therethrough;

said valve assembly being in flow communication with said first and second inlet/outlets;

each of said poppet discs being mounted on a separate rod;

an eccentric mechanical drive, said eccentric mechanical drive having a drive shaft and a drive disc at each end of said drive shaft;

linkage attached to said drive shaft at said drive discs; and said rods being attached to said linkage.

2. The regenerative thermal oxidizer recited in claim 1, wherein said eccentric mechanical drive includes a variable speed motor and a reducing gear assembly for moving said poppet discs at predetermined rates of acceleration and deceleration.

3. The regenerative thermal oxidizer recited in claim 2, wherein said reducing gear assembly further includes at least one proximity switch in association with said drive shaft, wherein said proximity switch emits a signal representative of the rotational position of said drive shaft for actuating at least said predetermined rate of deceleration.

4. The regenerative thermal oxidizer recited in claim 1, wherein said first and second heat exchangers are attached to a common combustion chamber positioned between said first flow path and said second flow path.

5. The regenerative thermal oxidizer recited in claim 1, wherein said linkage includes an over-drive bearing spring assembly and a connecting rod.

6. The regenerative thermal oxidizer recited in claim 2, wherein said reducing gear assembly allows rotation of the drive shaft in a single direction.

7. The regenerative thermal oxidizer recited in claim 5, wherein said linkage includes a yoke and collar.

8. The regenerative thermal oxidizer recited in claim 5, wherein said drive discs each has an eccentrically mounted pin.

9. The regenerative thermal oxidizer recited in claim 8, wherein said over-drive bearing spring assemblies each has a spring biased block which receive on of said eccentrically mounted pins.

10. A regenerative thermal oxidizer, comprising:

a first heat exchanger defining a first flow path;

a first inlet/outlet in association with said first heat exchanger, said first inlet/outlet providing flow access to said first flow path;

a second heat exchanger defining a second flow path;

a second inlet/outlet in association with said second heat exchanger, said second inlet/outlet providing flow access to said second flow path;

wherein said first and second heat exchangers are attached to a common combustion chamber positioned between said first flow path and said second flow path;

a valve assembly having at least two poppet discs, said valve assembly defining multiple flow passages therethrough;

said valve assembly being in flow communication with said first and second inlet/outlets;

each of said poppet discs being mounted on a separate rod;

an eccentric mechanical drive, wherein said eccentric mechanical drive includes a variable speed motor and a reducing gear assembly for moving said poppet discs at predetermined rates of acceleration and deceleration;

said eccentric mechanical drive having a drive shaft and a drive disc at each end of said drive shaft;

wherein said reducing gear assembly allows rotation of the drive shaft in a single direction;

linkage attached to said drive shaft at said drive discs;

wherein said linkage includes an over-drive bearing spring assembly and a connecting rod; and said rods being attached to said linkage.

11. The regenerative thermal oxidizer recited in claim 10, wherein said reducing gear assembly further includes at least one proximity switch in association with said drive shaft, wherein said proximity switch emits a signal representative of the rotational position of said drive shaft for actuating at least said predetermined rate of deceleration.

12. The regenerative thermal oxidizer recited in claim 10, wherein said linkage includes a yoke and collar.

13. The regenerative thermal oxidizer recited in claim 10, wherein said drive discs each has an eccentrically mounted pin.

14. The regenerative thermal oxidizer recited in claim 13, wherein said over-drive bearing spring assemblies each has a spring biased block which receive one of said eccentrically mounted pins.

15. A regenerative thermal oxidizer, comprising:

two heat exchange chambers;

a common combustion chamber in flow communication with said heat exchangers;

an inlet/outlet valve system for directing gases through said heat exchangers and said combustion chamber;

said inlet/outlet valve system having four butterfly valves;

an eccentric mechanical drive, said eccentric mechanical drive having a drive shaft;

a first drive disc at one end of said drive shaft;

a second drive disc at the other end of said drive shaft;

first linkage attached to said first drive disc;

second linkage attached to said second drive disc;

said first linkage being attached to two of said butterfly valves; and said second linkage being attached to said other two of said of said butterfly valves.

16. The regenerative thermal oxidizer recited in claim 15 wherein said first linkage includes two over-drive bearing spring assemblies and two connecting rods.

17. The regenerative thermal oxidizer recited in claim 16 wherein said first linkage includes two yoke and swivel assemblies and said second linkage includes another two yoke and swivel assemblies.

18. The regenerative thermal oxidizer recited in claim 16, wherein said drive discs each have an eccentrically mounted pin.

19. The regenerative thermal oxidizer recited in claim 18, wherein said over-drive bearing spring assemblies each have a spring biased block which receive one of said eccentrically mounted pins.

* * * * *